US005713479A

United States Patent [19]

Brady

[11] Patent Number: 5,713,479

[45] Date of Patent: Feb. 3, 1998

[54] MOLDED PLASTIC SCREW CAP HAVING ANTI-BACKOFF THREAD

[75] Inventor: James Brady, Roselle Park, N.J.

[73] Assignee: Vincent T. Brady, Cranford, N.J.

[21] Appl. No.: 719,455

[22] Filed: Sep. 25, 1996

[51] Int. Cl.[6] ..... B65D 41/04

[52] U.S. Cl. ..... 215/330; 215/44

[58] Field of Search ..... 215/329, 330, 215/331, 344, 343, 43, 44, 45; 220/289

[56] References Cited

U.S. PATENT DOCUMENTS

| | | | |
|---|---|---|---|
| 2,162,880 | 6/1939 | Brown | 215/330 |
| 3,405,831 | 10/1968 | Hudson | 215/330 |
| 3,682,345 | 8/1972 | Baugh | 215/330 |
| 3,851,784 | 12/1974 | Gryncewicz | 215/344 |
| 4,106,654 | 8/1978 | Jones | 215/329 |
| 4,125,201 | 11/1978 | Birch | 215/330 |
| 4,325,487 | 4/1982 | Libit | 215/330 |
| 4,349,116 | 9/1982 | Luesner | 215/330 |
| 4,461,394 | 7/1984 | Sendel et al. | 215/330 |
| 4,697,715 | 10/1987 | Beruvides | 215/330 |

*Primary Examiner*—Allan N. Shoap
*Assistant Examiner*—Nathan Newhouse
*Attorney, Agent, or Firm*—H. Gibner Lehmann; K. Gibner Lehmann

[57] ABSTRACT

An anti-backoff screw cap construction for a container neck having a thread with a downwardly-facing pressure face and an upwardly-facing relief face. The cap has a depending skirt having an internal thread with an upwardly-facing pressure face for engagement with the downwardly-facing pressure face of the container neck thread. Engagement results in tightening of the cap on the container neck when the cap is turned in a screwing-on direction. The cap thread has a downwardly-facing relief face having as an anti-backoff structure, an elongate, substantially helical, resilient projecting bead which is integral with the cap thread, the bead being coextensive with an uppermost portion of its downwardly-facing relief face and being directly engageable by the upwardly-facing relief face of the container neck thread. The projecting bead is resiliently deformed by its engagement with the upwardly-facing relief face of the container neck thread when the cap is turned in its screwing-on direction. The deformed projecting bead elastically and frictionally grips the upwardly-facing relief face of the container neck thread so as to reduce the tendency for the cap to become inadvertently unscrewed from its fully screwed-on position. A highly effective retention of the cap results, without the need for complex molded locking lugs, teeth or the like.

12 Claims, 3 Drawing Sheets

20
34
A
32
30
5
20
5
28
26
36
24
26

20
30
32
26

MOLDED PLASTIC SCREW CAP HAVING ANTI-BACKOFF THREAD

NO CROSS REFERENCES TO RELATED APPLICATIONS

Statement as to Rights to Inventions made under Federally-Sponsored Research and Development Research and development of the present invention and application have not been Federally-sponsored, and no rights are given under any Federal program.

BACKGROUND OF THE INVENTION

Field of the Invention

Description of the Related Art Including Information Disclosed under 37 CFR §§1.97–1.99

This invention relates generally to screw cap constructions for containers having threaded necks, and more particularly to devices of the type having special structures to minimize inadvertent loosening of the cap once it has been applied to the container, as during handling and/or shipping.

The following patents are hereby made of record, as being related to the field to which the present invention pertains:

| U.S. Patents Nos.: | | |
|---|---|---|
| 3,511,403 | 3,606,063 | 3,682,345 |
| 4,325,487 | 4,461,394 | 5,105,960 |
| 5,169,033 | 5,292,020 | 5,462,186 |
| 5,411,157 | | |

U.S. Pat. No. 5,169,033 discloses a screw cap for a container, the cap having an interrupted thread in the form of three thread segments, for installation on a threaded bottle neck. The material of the bottle neck is relatively soft with respect to that of the screw cap. The lower convolution of the cap thread has a series of projecting teeth arranged to bite into the container neck thread with a force sufficient to deform it and become embedded therein. The projecting teeth thereafter abut the resultant deformations in the neck thread, such abutment operating to prevent inadvertent back-off of the screw cap once the latter has been fully seated or screwed down.

U.S. Pat. No. 4,325,487 involves a screw cap construction having an internal thread provided with a coextensive resilient flap on the inner surface of the cap body. The flap can flex as the cap is screwed onto a container neck. As the cap is tightened, the flap is displaced laterally and becomes tightly wedged between the crest of the bottle neck thread and a truncated surface of the cap thread. There occurs a binding action which tends to resist inadvertent unscrewing of the cap.

U.S. Pat. No. 3,511,403 relates to an anti-backoff arrangement wherein interrupted threads on a bottle neck provide relieved areas into which spaced-apart portions of the cap thread are forced during application of the cap. The spaced-apart portions of the cap thread become deformed so as to abut the ends of the interrupted threads on the bottle neck. The resulting abutment in turn resists inadvertent loosening of the cap.

U.S. Pat. No. 5,105,960 discloses a dispenser having cooperable threads on a container neck and a screw cap, wherein the engaging surfaces of the cooperable threads are provided with ribbed-configurations, somewhat in the manner of miniature ratchet teeth. The teeth are forced to by-pass one another during application of the cap. The continuing engagement of the teeth interferes with incidental or inadvertent unscrewing of the cap.

U.S. Pat. No. 3,682,345 relates to an anti-backoff screw cap construction involving a bottle neck having multiple axially extending projections or nibs on the undersurface of its thread formations, which bite into a cooperable thread of a screw cap and effect a cold flow of the plastic substance of which the cap is constituted. The cold flow results in depressions being imparted to the cap thread at the respective points of contact; after a period of time, the depressions take a set, and form with the projections, interlocking parts which resist inadvertent sliding movement, to the extent that incidental loosening of the cap is prevented.

U.S. Pat. No. 5,292,020 relates to a screw cap construction having a transverse top wall and a depending skirt, wherein the inner surface of the skirt is provided with one or more circumferential ribs that ultimately engage the uppermost convolution of the thread of the bottle neck with which the cap is used. The ribs are located between the uppermost convolution of the internal cap threads and the transverse top wall of the cap. Several different rib forms are disclosed.

Still another anti-backoff screw cap construction is shown in U.S. Pat. No. 4,461,394. In FIG. 1, the lower surface of the thread of a container neck is provided with a series of protuberances; the internal thread of the cap has corresponding protuberances which slidably engage and by-pass those of the neck thread when the cap is applied. The resulting interference between the protuberances in an unscrewing direction, operates to minimize incidental loosening of the screw cap once the latter has been permanently tightened on the container neck.

U.S. Pat. No. 3,606,063 relates to a closure cap construction comprising a cap body with a transverse top wall and a depending skirt which has radially-inwardly extending molded projections. The latter engage the container neck above the location of its own threads, and become deformed or compressed against the neck so as to reduce the tendency for the cap to loosen. The points of engagement of the projections with the neck are at a generally smooth, cylindrical surface thereof immediately adjacent the container lip.

U.S. Pat. No. 5,462,186 discloses a combined bottle thread/cap thread arrangement which provides for automatic venting of the bottle as the cap is being initially unscrewed and prior to complete loss of engagement of the threads of the cap with those of the container neck. The disclosed structure purportedly reduces the possibility of the cap being inadvertently forcefully propelled off of the neck, as by gas (from carbonated sodas and the like) which may have built up in the container. Also, in FIGS. 1 and 2 of the patent, there are provided anti-back off structures comprising thread segments (66, 68), and bumps (72, 74) on the bottle neck; and bar members (76, 78), on the cap, which selectively engage one another to prevent free unscrewing movement of the cap.

U.S. Pat. No. 5,411,157 discloses still other arrangements for reducing inadvertent loosening of a screw cap. One embodiment, FIG. 16, illustrates radially-outwardly projecting camming lugs (525) which are engageable respectively with axial radially-inwardly projecting ribs (536) on the inner surface of a screw cap. The lugs (525) have shallow ramp surfaces (525*a*) and steep retention surfaces (525*b*). The ribs (536) ultimately by-pass and thereafter are engaged by the retention surfaces (525*b*) when the cap is fully seated. Inadvertent unscrewing of the cap is thereby prevented. The operation is described briefly in col. 35, line 35, through col. 36, line 19.

SUMMARY OF THE INVENTION

It appears that few if any of the devices which are the subjects of the patents above identified have become commercialized to a wide extent, and accordingly there has existed a long-standing and ongoing need for improvements in container field, as for example in manufacturing or assembly techniques, material costs, and the like.

Accordingly it is one object of the present invention to provide a novel and improved anti-backoff screw cap construction which is both simple in its structure, and easy to apply and use.

Another object of the invention is to provide a novel and improved anti-backoff screw cap construction as above characterized, which is highly effective due to almost complete elimination of the tendency for the cap to become inadvertently loosened following initial installation and tightening onto the container with which the cap is used.

Still another object of the invention is to provide an improved anti-backoff screw cap construction in accordance with the foregoing, which can be utilized with existing container thread formations of generally standard size and configuration, thereby eliminating the need for special container neck finishes and the like.

Yet another object of the invention is to provide an improved anti-backoff screw cap construction of the kind indicated, which can be inexpensively manufactured at substantially no increase in cost as compared to that involved with conventional closures not having a reduced back-off feature.

The above objects are accomplished by the provision of a novel and improved anti-backoff screw cap construction for use on a container neck, the neck having a thread with a downwardly-facing pressure face and an upwardly-facing relief face, and the screw cap construction comprising, in combination a cap body having a transverse top wall and an integrally-formed depending skirt having an internal thread. The cap body thread has an upwardly-facing pressure face for engagement with the downwardly-facing pressure face of the container neck thread, whereby the engagement thereof results in tightening of the cap body on the container neck when the cap body is turned in a screwing-on direction. The cap body thread further has a downwardly-facing relief face having anti-backoff means thereon, the anti-backoff means comprising an elongate, substantially helical, resilient projecting bead which is integral with the cap body thread, the bead being coextensive with an uppermost portion of the downwardly-facing relief face and being directly engageable by the upwardly-facing relief face of the container neck thread. The projecting bead is resiliently deformed by its engagement with the upwardly-facing relief face of the container neck thread when the cap body is turned in its screwing-on direction. The deformed projecting bead elastically and frictionally grips the upwardly-facing relief face of the container neck thread so as to reduce the tendency for the cap body to become inadvertently unscrewed from its fully screwed-on position.

A highly effective retention of the cap body results, without the need for complex molded locking lugs, teeth or the like, on either the cap body or the container neck.

The resulting anti-backoff screw cap construction can be economically manufactured at a cost which is essentially the same as that required for a conventional screw cap of a type which does not incorporate anti-backoff measures.

Other features and advantages will hereinafter appear.

DESCRIPTION OF THE PREFERRED EMBODIMENT

Figure 1:
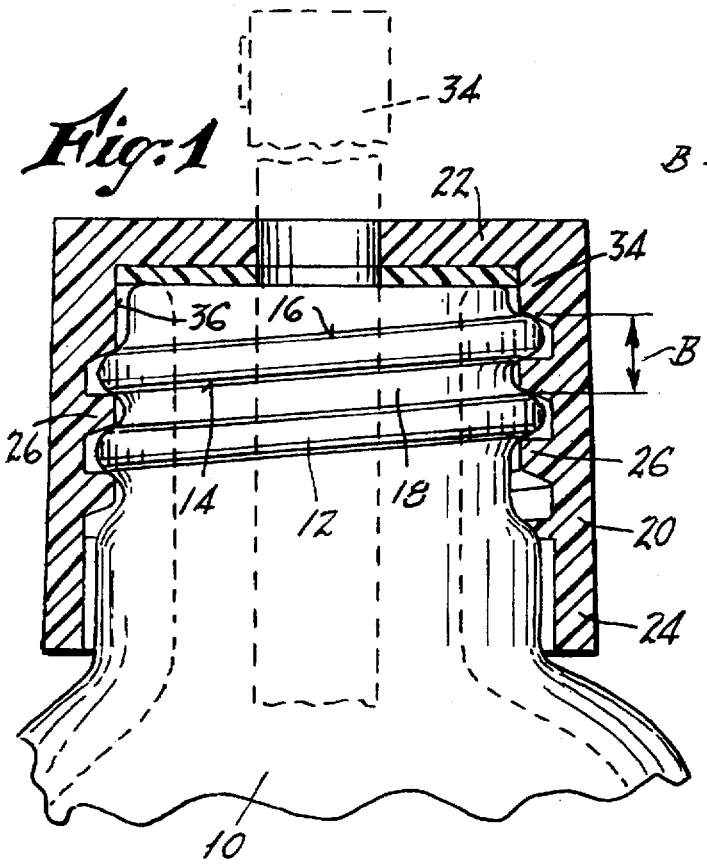
FIG. 1 is a fragmentary view, partly in elevation and partly in axial section, of a container having applied thereto, the anti-backoff screw cap construction of the present invention. Optionally the screw cap may be apertured, for use with a dispensing pump, shown in dotted outline in the figure.
Figure 6:
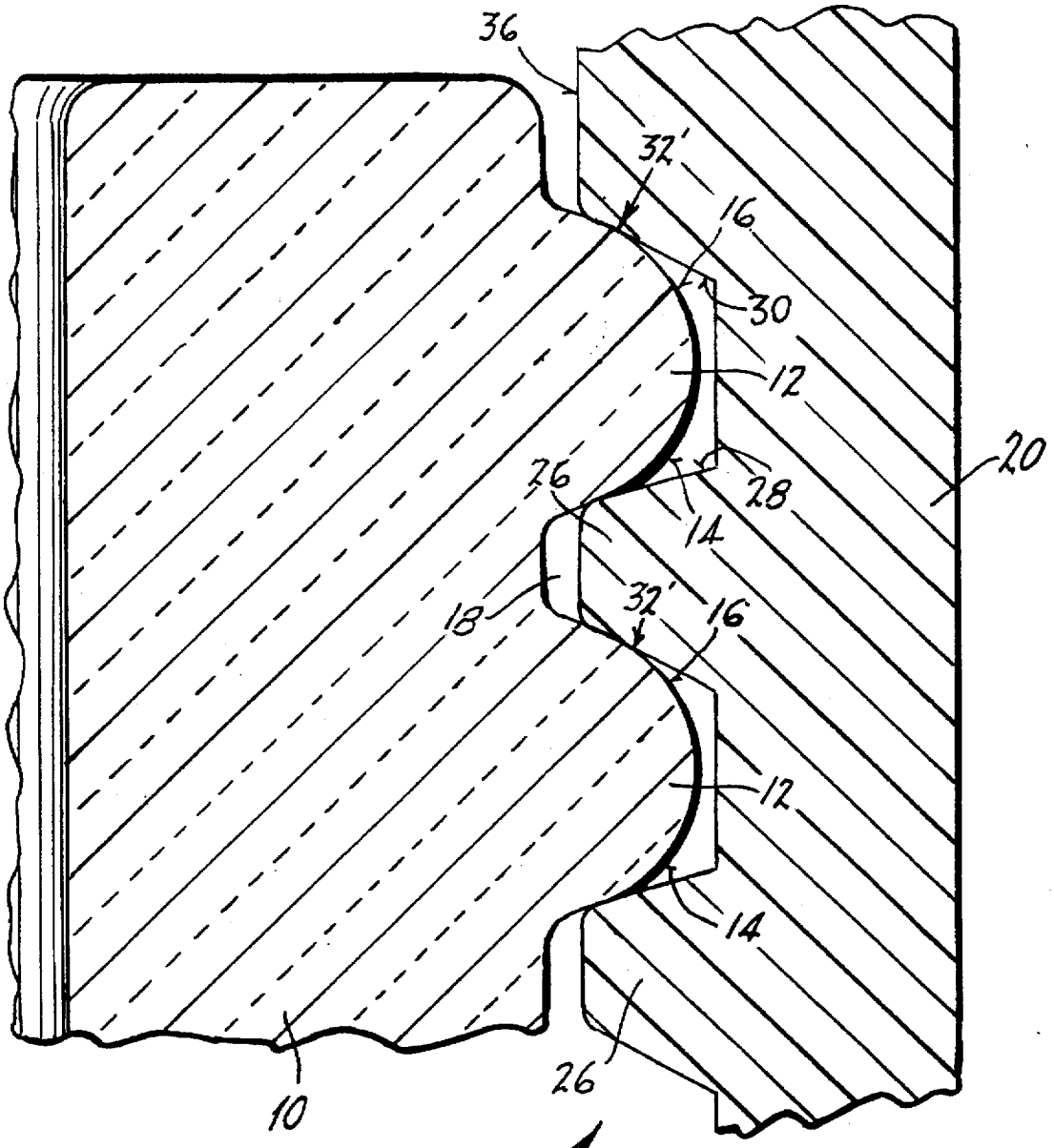
FIG. 6 is a fragmentary section, greatly enlarged and somewhat exaggerated, of the area designated B in FIGS. 1 and 3.

Referring first to FIGS. 1 and 6 there is illustrated a container generally designated by the numeral 10, having a neck with an external thread 12, the latter having a downwardly-facing pressure face 14 and an upwardly-facing relief face 16, both of which in general can be of standard configuration in the case of a glass bottle. Containers of this type generally are provided with what is known in the trade as a "fat thread", in that the width of the thread 12 is relatively large, and commensurate in size with or very slightly larger than the width of the groove 18 that exists between the convolutions of this thread. This is shown generally in FIG. 6.

Figures 4, 5:
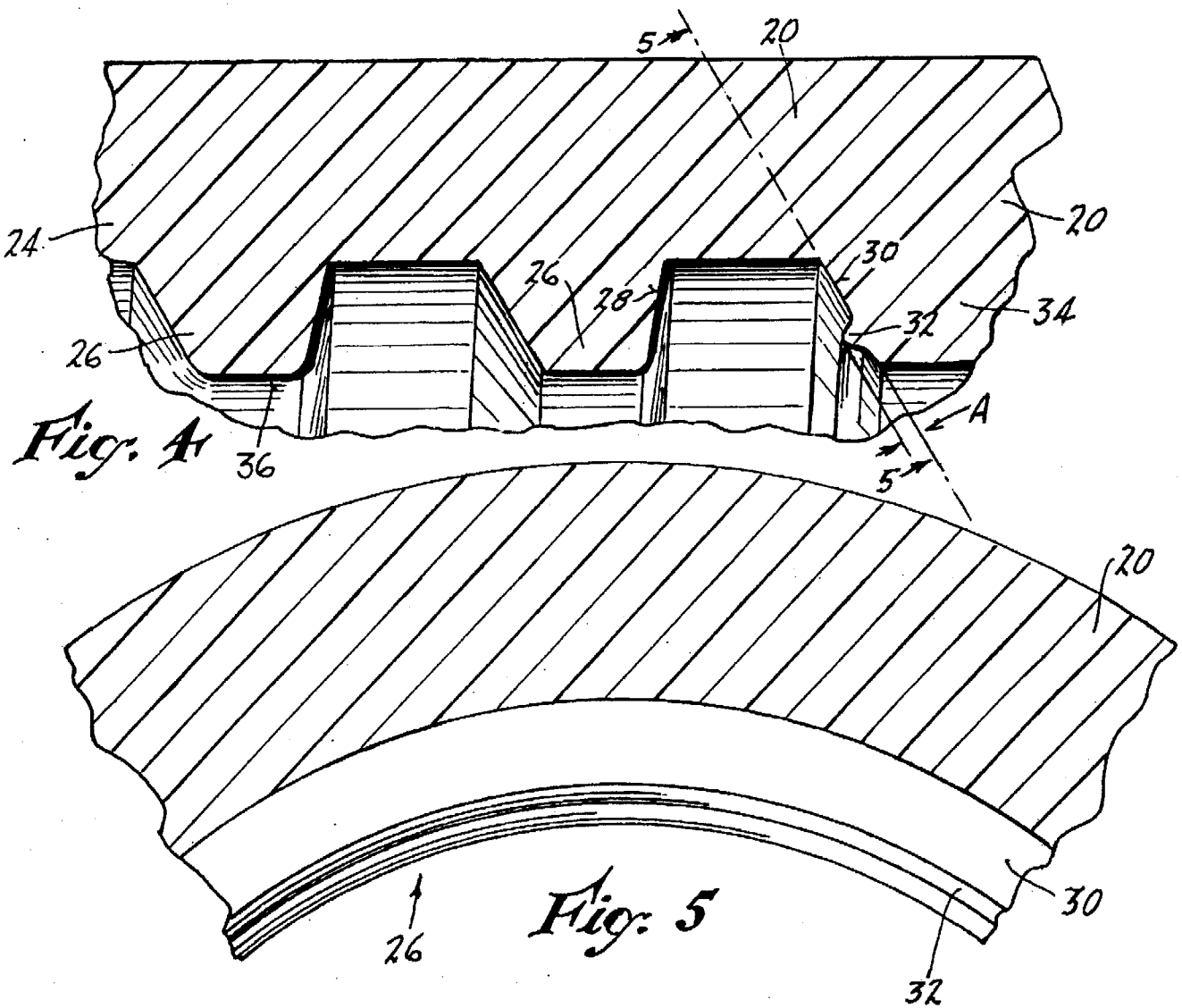
FIG. 4 is a fragmentary section, greatly enlarged and somewhat exaggerated, taken on the line 4—4 of FIG. 2.
FIG. 5 is a fragmentary section, greatly enlarged and somewhat exaggerated, taken on the line 5—5 of FIG. 4.

In accordance with the present invention there is provided a novel and improved anti-backoff screw cap construction for use with the container 10, comprising a cap body 20 having a transverse top wall 22 and an integrally-formed depending skirt 24 which is provided with an internal thread 26. As shown in FIGS. 1, 4 and 6, the thread 26 of the cap body 20 extends through several convolutions, forming a helix and having an upwardly-facing pressure face 28 for engagement with the downwardly-facing pressure face 14 of the container neck thread 12, and having a downwardly-facing relief face 30 for engagement with the upwardly-facing relief face 16 of the container thread 12.

Novel anti-backoff means are provided on the downwardly-facing relief face 30 of the cap body thread 12, in the form of an elongate, substantially helical, resilient or yieldable projecting bead 32 which is integral with the cap body thread 26 and coextensive with an uppermost portion of the downwardly-facing relief face 30. Preferably the bead 32 extends along the uppermost convolution of the cap thread 12, for substantially a single turn, as is depicted in FIG. 3, which is a development of the inner surface of the cap body 20.

Figure 3:
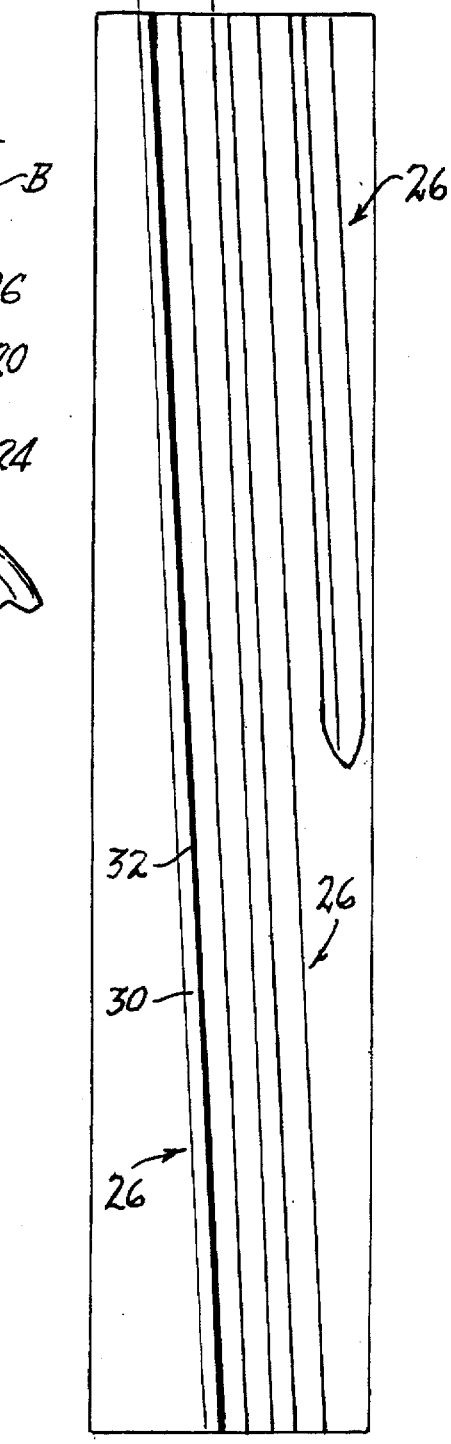
FIG. 3 is a development of the thread formation of the screw cap construction of the invention, particularly illustrating the internal thread of the cap, and an anti-backoff projecting bead on the uppermost portion of the upper, top convolution of the thread.
Figure 2:
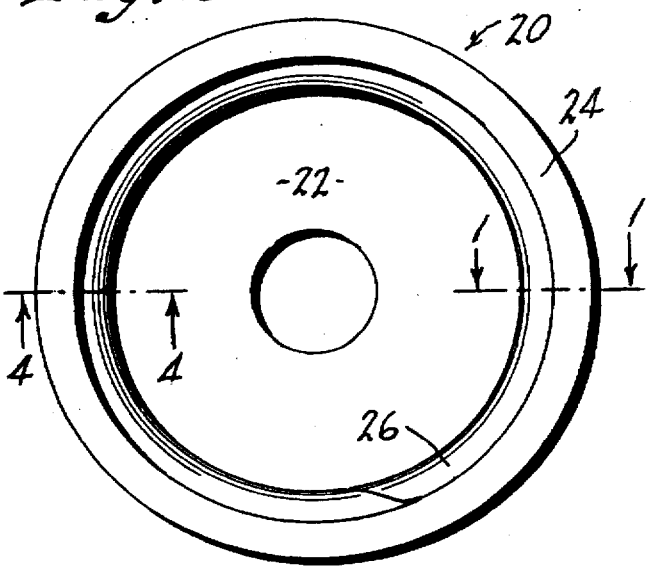
FIG. 2 is a bottom plan view of the screw cap construction of FIG. 1.

The cap body thread 26, on the uppermost portion of which the bead is disposed begins at the upper portion of FIG. 3, and continues through substantially two and one-half convolutions, at which point it tapers into the inner surface of the cap body 20. In practice, the uppermost convolution of the cap body thread 26 merges into an annular internal shoulder of the cap body, designated 34 in FIG. 1, and the upper end of the bead 32 similarly merges into the shoulder 34. The inner surface 36 of the shoulder 34 is generally cylindrical, and it can be seen in FIG. 4 that the bead 32 lies radially outside of this cylindrical surface. Also, the crest of the cap thread 26 preferably lies more or less in this same cylindrical surface 36.

FIG. 4 shows the bead 32 in somewhat greater detail, where-in the height of the bead is designated by the letter "A". In practice, the dimension "A" is on the order of several thousandths of an inch, typically 0.005 inch or so. By the invention, the thread 26 and bead 32 are constituted of resilient or somewhat plastic substance, such as polypropylene, which has the necessary "memory" characteristics to render the bead 32 resilient, with a tendency to restore itself to its original configuration in the event it is forcibly deformed or squashed. FIG. 6 shows the bead 32 essentially completely flattened or deformed, as occurs when the screw cap body 20 is fully seated on the container neck. The deformation occurs as a consequence of the forcible screwing-on of the cap body 20 which occurs during the capping process. As can now be readily understood, during the last "turn" or so, slightly increased resistance to screwing on is encountered, as the rigid face 16 compresses and deforms the resilient bead 32. The resilience of the bead 32 under such circumstances, results in a tendency for it to spring back against the rigid face 16, creating a frictional drag which opposes any tendency for the cap body 20 to move in an unscrewing direction. The force provided is substantially greater than that which would prevail if the bead were omitted.

In summary, as the screw cap body 20 is tightened on the container neck, toward a fully screwed-on condition as in FIGS. 1 and 6, the bead 32 is squeezed and flattened, or deformed by virtue of its engagement with the broad uppermost portion of the relief face 16 of the container neck thread 12. Due to the resiliency of the plastic of which the cap body and bead are constituted, the flattened bead, designated 32, 32', tends to restore itself to its original, undeformed condition, even in the presence of the continued flattening force being exerted upon it. Accordingly, a continuous friction force is maintained by the container thread 12 on the flattened bead 32', which force has a substantial component that is normal to the surface of the thread. This in effect maximizes the retention effect of the container on the bead 32'.

As noted, FIG. 6 shows the bead 32' of the screw cap body 20 fully deformed, that is, the bead 32' has been resiliently squeezed into the surface of the cap thread. As presently understood, in such a deformed condition the bead continues to exert an outward, normal force against the adjacent surface of the container thread. The resultant tendency for binding which occurs, gives rise to the drag that opposes any tendency for the screw cap body to be dislodged from its fully screwing-on position shown in FIG. 1.

Referring again to FIG. 6, and by the invention, where the thread 12 of the container 10 is of the "fat" type the screw cap body thread 26 can be molded so as to largely fill in the groove 18 between the adjacent convolutions of the container thread 12. Under this circumstance, the crest of the cap body thread 26 is effectively squeezed between the convolutions of the container neck thread 12, enhancing the pressure that is applied to the bead 32', and thus giving rise to a relatively higher pressure contact between the rigid (glass, for example) container neck, and the relatively soft (polypropylene) cap body bead 32. Through actual tests it has been determined that an unusually high retention of the screw cap body 20 is attained, through the continued pressure that exists between the flattened bead 32' and the adjacent face of the container neck thread 12.

The disclosed construction has a number of distinct advantages which are not found in the devices of the prior art of record. In particular, due to the fact that the retention bead 32 is disposed on the relief face 30 of the cap body thread 26, there occurs absolutely no interference between the container and cap body threads during the initial engagement thereof, as during "starting" of the threads. Moreover, the anti-backoff bead 32 is located deeply within the hollow part of the cap body 20, adjacent the transverse wall 22 thereof. Thus, from the time that the threads initially engage one another until just prior to the cap body being fully screwed-on, the retention bead 32 is essentially free of contact with any part of the container thread 12. By such an arrangement, while installing the caps by hand, a worker would not notice any difference between installing the screw cap body of the invention and installing a conventional cap body, until just prior to the body arriving at a fully seated condition. At such time, a slight increase in the capping torque would be needed, since the retention bead 32 of the cap body of the present invention would only then begin to be engaged with and deformed by the container thread 12.

An especially simple and effective arrangement is thus seen to realized.

While the disclosed embodiment shown in FIG. 1 includes an apertured cap body, for use with a manually-operable pump mechanism 34, shown in dotted outline, the principles of the invention can similarly be applied to a screw cap of any type, specifically one having a solid or imperforate transverse top wall 22. Accordingly the invention is not intended to be restricted solely to applications incorporating pump mechanisms or the like, but instead can be adapted for use with any type of screw cap constituted of molded plastic substance, and where the material of the cap is relatively softer than that of the container neck, From the above it can be seen that I have provided a novel and improved anti-backoff screw cap construction which is extremely simple in its structure and cost-effective in manufacture and assembly. No special tools or equipment are required when installing the cap onto the container. If desired, conventional capping equipment can be readily utilized.

The disclosed anti-backoff screw cap of the invention is thus seen to represent a distinct advance and improvement in the field of threaded closures.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. An anti-backoff screw cap construction and a container neck comprising, in combination:

a) a neck having a thread with a downwardly-facing pressure face and an upwardly-facing relief face, b) a cap body having a transverse top wall and an integrally-formed depending skirt having an internal thread, c) said cap body thread having an upwardly-facing pressure face for engagement with the downwardly-facing pressure face of the container neck thread, whereby the engagement thereof results in tightening of the cap body on the container neck when the cap body is turned in a screwing-on direction, d) said cap body thread further having a downwardly-facing relief face having means for preventing backoff thereon, said means comprising an elongate, substantially helical, resilient projecting bead which is integral with the cap body thread, said bead being coextensive with an uppermost portion of said downwardly-facing relief face and being directly engageable by the upwardly-facing relief face of the container neck thread, said projecting bead being resiliently deformed by said engagement with the upwardly-facing relief face of the container neck thread when the cap body is turned in said screwing-on direction, and said deformed projecting bead elastically and frictionally gripping said upwardly-facing relief face of the container neck thread so as to reduce the tendency for the cap body to become inadvertently unscrewed from its fully screwed-on position.

2. An anti-backoff screw cap construction and a container neck as set forth in claim 1, wherein said bead extends substantially through a complete convolution of said cap body thread.

3. An anti-backoff screw cap construction and a container neck as set forth in claim 1, wherein said projecting bead is substantially coextensive with the uppermost convolution of said cap body thread.

4. An anti-backoff screw cap construction and a container neck as set forth in claim 1, wherein said projecting bead has a height of approximately 0.005 inch.

5. An anti-backoff screw cap construction and a container neck as set forth in claim 1, wherein said projecting bead merges into the cap body at the area where the uppermost convolution of the cap body thread merges into the cap body.

6. An anti-backoff screw cap construction and a container neck as set forth in claim 1, wherein said cap body is constituted of polypropylene.

7. An anti-backoff screw cap construction and a container neck as set forth in claim 1, wherein said container is constituted of glass, and the thread thereof is substantially rigid so as to remain essentially undeformed during engagement thereof with the said projecting bead.

8. An anti-backoff screw cap construction and a container neck as set forth in claim 1, wherein said cap body has a cylindrical inner wall surface, and all portions of said projecting bead lying substantially completely radially outside of said cylindrical inner wall surface.

9. An anti-backoff screw cap construction and a container neck as set forth in claim 1, wherein the material of which the container is constituted is substantially rigid, and the material of which the cap is constituted is resilient plastic.

10. An anti-backoff screw cap construction and a container neck comprising, in combination:

a) a neck having a thread with a downwardly-facing pressure face and an upwardly-facing relief face, b) a cap body having a transverse top wall and an integrally-formed depending skirt having an internal thread, c) said cap body thread having an upwardly-facing pressure face for engagement with the downwardly-facing pressure face of the container neck thread, whereby the engagement thereof results in tightening of the cap body on the container neck when the cap body is turned in a screwing-on direction, d) said cap body thread further having a downwardly-facing relief face, and e) means for preventing backoff comprising an elongate, resilient projecting bead which is integral with the cap body thread, said bead being coextensive with said downwardly-facing relief face of said cap body thread, said projecting bead being resiliently deformed by engagement with said upwardly-facing relief face of said container neck thread when the cap body is turned in said screwing-on direction, and said deformed projecting bead elastically and frictionally gripping said upwardly-facing relief face of the container neck thread so as to reduce the tendency for the cap body to become inadvertently unscrewed from its fully screwed-on position.

11. An anti-backoff screw cap construction and a container neck as set forth in claim 10, wherein the thread of the container neck is substantially continuously squeezed between the upwardly-facing pressure face and the downwardly-facing relief face of the cap body thread, when the cap body is disposed in its fully screwed-on position.

12. An anti-backoff screw cap construction and a container neck as set forth in claim 10, wherein:

a) the convolutions of the container neck thread form a groove therebetween, b) the walls of the groove respectively forcibly engaging both the pressure face and the relief face of the cap body thread substantially at all times that the cap body is disposed in its fully screwed-on position.

* * * * *